US008630433B2

(12) United States Patent
Guth et al.

(10) Patent No.: US 8,630,433 B2
(45) Date of Patent: Jan. 14, 2014

(54) DEVICE AND METHOD FOR IN-EAR SOUND GENERATION

(75) Inventors: Heimo Guth, Bad Rippoldsau-Schapbach (DE); Carsten Merkle, Pluederhausen (DE)

(73) Assignee: SONY Corporation, Tokyo (JP)

( * ) Notice: Subject to any disclaimer, the term of this patent is extended or adjusted under 35 U.S.C. 154(b) by 254 days.

(21) Appl. No.: 13/041,790

(22) Filed: Mar. 7, 2011

(65) Prior Publication Data

US 2011/0249849 A1 Oct. 13, 2011

(30) Foreign Application Priority Data

Apr. 13, 2010 (EP) ..... 10003906

(51) Int. Cl.
*H04R 25/00* (2006.01)

(52) U.S. Cl.
USPC ..... 381/317; 381/238

(58) Field of Classification Search
USPC ..... 381/328, 380, 121, 318; 181/130
IPC ... H04R 25/00; G10K 11/16; H04B 3/20,15/00; A61F 11/08; G02C 11/06
See application file for complete search history.

(56) References Cited

U.S. PATENT DOCUMENTS

| | | | |
|---|---|---|---|
| 7,043,037 | B2 | 5/2006 | Lichtblau |
| 2005/0047620 | A1 | 3/2005 | Fretz |
| 2008/0192971 | A1 | 8/2008 | Tateno et al. |
| 2009/0238387 | A1 | 9/2009 | Arndt et al. |
| 2010/0220881 | A1 | 9/2010 | Arndt et al. |

FOREIGN PATENT DOCUMENTS

| | | | |
|---|---|---|---|
| JP | 2004-48207 | | 2/2004 |
| WO | WO 2009/134107 | A2 | 11/2009 |
| WO | WO 2009134107 | A2 * | 11/2009 |

OTHER PUBLICATIONS

Extended European Search Report Issued Dec. 22, 2011, in European Patent Application No. 11001702.7.

* cited by examiner

*Primary Examiner* — Curtis Kuntz
*Assistant Examiner* — Sunita Joshi
(74) *Attorney, Agent, or Firm* — Oblon, Spivak, McClelland, Maier & Neustadt, L.L.P.

(57) ABSTRACT

A device for in-ear sound generation comprises a sound determining unit adapted to determine a first sound signal, a sound collecting unit exposed to the ear canal and adapted to collect a second sound signal, a sound correction determining unit adapted to determine a third sound signal, and a loudspeaker exposed to an ear canal and adapted to emit the third sound signal The third sound signal includes the first sound signal and a correction component, the correction component essentially corresponding to a weighted and phase-inverted signal. The phase-inverted signal is obtained by phase inversion from a difference signal essentially corresponding to a difference between the second sound signal and the first sound signal.

14 Claims, 7 Drawing Sheets

DEVICE AND METHOD FOR IN-EAR SOUND GENERATION

An embodiment of the invention relates to a device for in-ear sound generation. A further embodiment of the invention relates to a method for in-ear sound generation.

BACKGROUND

When designing in-ear earphones, in-ear sound generation and wearing comfort are important challenges. If the ear canal is completely or nearly completely closed by an in-ear earphone inserted in the ear canal, the sound perceptible for a user may be influenced by unwanted reflections. For example, sounds emanating from the user's body may be reflected at the ear canal closing, and may interfere with the sound emitted by the earphone. Generating sound with a high quality enjoyable for a user is therefore an important issue.

BRIEF SUMMARY

It is an object of the invention to provide a device for in-ear sound generation with enhanced quality of sound perceptible for a user. A further object is to provide a method for in-ear sound generation with enhanced quality of sound perceptible for the user.

These objects are solved by a device and a method for in-ear sound generation according to the independent claims.

Further details of the invention will become apparent from a configuration of the drawings and the ensuing description.

BRIEF DESCRIPTION OF THE SEVERAL VIEWS OF THE DRAWINGS

The accompanying drawings are included to provide a further understanding of embodiments and are incorporated in and constitute part of this specification. The drawings illustrate embodiments and together with the description serve to explain principles of embodiments. Other embodiments and many of the intended advantages of embodiments will be readily appreciated as they become better understood by reference to the following detailed description.

The elements of the drawings are not necessarily to scale relative to each other. Like reference numerals designate corresponding similar parts.

DETAILED DESCRIPTION

In the following, embodiments of the invention are described. It is important to note that all described embodiments may be combined in any way, i.e. that there is no limitation that certain described embodiments may not be combined with others. Further, the features of the various embodiments described herein may be combined with each other, unless specifically noted otherwise. It is further to be understood that other embodiments may be utilized, and that structural or logical changes may be made without departing from the scope of the invention. The following detailed description, therefore, is not to be taken in a limiting sense, and the scope of the present invention is defined by the appended claims.

Figure 1:
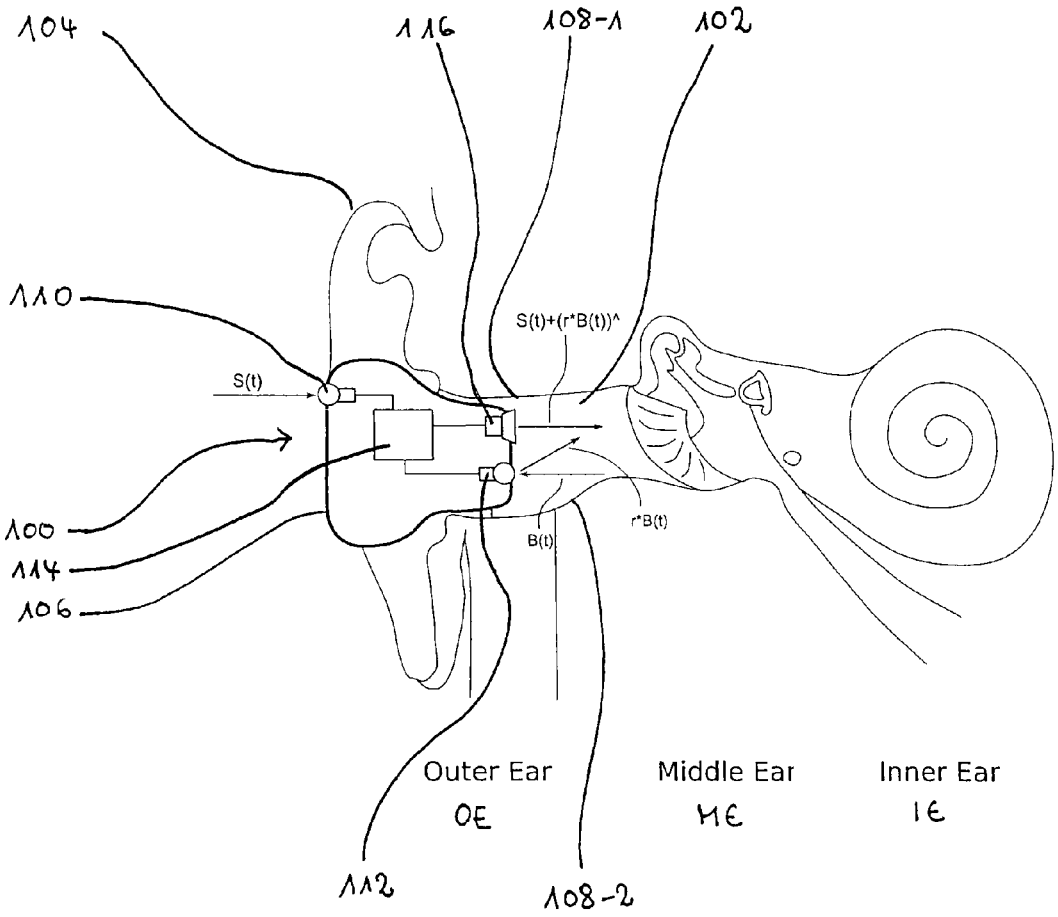
FIG. 1 illustrates an embodiment of a device for in-ear sound generation inserted into an ear canal of a user.

FIG. 1 schematically illustrates an in-ear earphone 100 for in-ear sound generation (canal phone) in a state in which in-ear earphone 100 is inserted in an ear canal 102 of an ear 104 of a user. Ear 104 includes an outer ear OE, a middle ear ME, and an inner ear IE, and ear canal 102 forms part of the outer ear OE.

In the example, in-ear earphone 100 includes a housing 106 which, when inserted in the ear canal, may abut walls 108-1, 108-2 of ear canal 102. When inserted in ear canal 102, in-ear earphone 100 may therefore essentially close ear canal 102, for example in an essentially air-tight manner.

When ear canal 102 is completely or nearly completely closed by earphone 100, sound signals present within ear canal 102 may be reflected by in-ear earphone 100 in an unnatural manner.

The reflected sound signals may, for example, arise from body sounds emanating from the user's body, such as a chewing, swallowing, coughing, sneezing, and/or laughing. Further, the reflected sound signals may also arise from a sound of user's voice, e.g. the user's own speech, and/or from the user's steps. Also, sounds emanating from an exterior environment of the user's body, e.g. from a train passing nearby, may be propagated through a flesh and through bones of the user, and may therefore be reflected by in-ear earphone 100.

Still further, also sound signals emitted by in-ear earphone 100 may be reflected in an unnatural manner. For example, these sound signals may be reflected back to in-ear earphone 100 by walls 108-1, 108-2 of ear canal 102 and by parts of the middle ear ME, and may then be reflected again. This is due to the fact that with in-ear earphone 100 closing ear canal 102, the latter becomes an essentially closed tubular structure sealed from the environment.

The reflected sound signals present in ear canal 102 may have an influence on the sound perceptible, i.e. audible, for the user. For example, the reflected sound signals may be present in ear canal 102 with a much higher intensity than under normal conditions, i.e. when in-ear earphone 100 is not inserted in ear canal 102. Thus, body sounds normally ignored by the user may be clearly perceptible for the user. Further, the reflected sound signals may interfere with each other and/or with a sound signal emitted by in ear earphone 100, causing disturbing effects. As a consequence, the reflected sound signals may reduce an impression of a quality of the sound experienced by the user, or may even disturb and/or annoy the user.

The presence of the reflected sound signals and the interference with the wanted sound signal may cause severe problems to the user. For example, due to the reflections, a quality, clarity and/or perceptibility of the emitted sound signal may be reduced, such that the user may be incited to raise a volume of sound emission of in-ear earphone 100. Still further, since body sounds may be amplified by the reflections, the user may try to adapt his or her behavior and may, for example, lower his or her voice or take care of his steps in an unnatural manner.

To circumvent these problems, in-ear earphone 100 may comprise a sound determining unit 110 adapted to determine a first sound signal. The first sound signal will, in the following, also be referred to as a "target sound signal" to be emitted, e.g. played, to the user. In the example illustrated in FIG. 1, sound determining unit 110 is a first microphone adapted to collect sound from an environment exterior from the ear canal. In this case, sounds surrounding the user may be collected and determined as the first sound signal (target sound signal).

Further, in-ear earphone 100 may include a sound collecting unit exposed to the ear canal and adapted to collect a second sound signal. The second sound signal will, in the following, also be referred to as "in-ear sound signal".

In the example, the sound collecting unit is a second microphone 112 disposed at housing 106. For example, second microphone 112 may be tightly or loosely coupled with housing 106, or held by housing 106, e.g. within a first opening directed to ear canal 102. Consequently, second microphone 112 may be open to ear canal 102 and may therefore be adapted to collect any sound signals present in ear canal 102. Thus, sound waves present in ear canal 102 may freely propagate to second microphone 112 through an air within ear canal 102.

As illustrated in the embodiment shown in FIG. 1, second microphone 112 may further be disposed within a predetermined distance from walls 108-1, 108-2, e.g. in a positive minimum distance of one or several millimeters. In this case, vibrations of walls 108-1, 108-2 must not be transmitted directly to second microphone 112 through vibrations of a structure of in-ear earphone 100, e.g. of housing 106, but may be collected from the air present in ear canal 102. This allows determining the in-ear sound signal as present within the sealed tubular structure of ear canal 102. Thus, an influence of the vibrations of walls 108-1, 108-2 may be minimized, such that an over-weighting of the vibrations as a signal component of the in-ear sound signal may be circumvented.

Further, in-ear earphone 100 may include a sound correction determining unit 114 adapted to determine a third sound signal, which in the following will also be referred to as "emission sound signal". Sound correction determining unit 114 may, for example, be a data processor, and/or may be specifically designed for sound signal processing.

Further, a loudspeaker 116, adapted to emit the emission sound signal determined by sound correction determining unit 114 may be provided. Loudspeaker 116 may be exposed to ear canal 102 and may be directed to the ear canal for emitting, e.g. making audible, the emission sound signal to the user. For example, the loudspeaker may be disposed at the housing, e.g. coupled tightly or loosely with the housing, and/or held by the housing within a second opening of the housing directed to the ear canal. Through the second opening, sound waves emitted by loudspeaker 116 may be directly transmitted to ear canal 102, e.g. may propagate through free air within ear canal 102 from outer ear OE to middle ear ME of the user.

Sound correction determining unit 114 may, as well as other electronic components of in-ear earphone 100, be supplied with power from a battery (not shown) disposed within housing 106, and/or from an external power source (not shown), e.g. from an external device.

In the embodiment, the third sound signal (emission sound signal emitted by loudspeaker 116) includes the first sound signal (target sound signal determined by sound determining unit 110) and a correction component. The correction component may essentially correspond to a weighted and phase-inverted signal obtained by phase inversion from a difference signal.

For example, the correction component may be equal to the weighted and phase-inverted signal. However, the correction component may also slightly deviate from the weighted and phase-inverted signal. Deviations may occur e.g. due to rounding errors which may take place during a calculation within the data processor included in sound correction determining unit 114, for example when calculating phase-inversion or weighting the corresponding result. Further, deviations may also be introduced due to measurement errors, e.g. when mapping sound collected by microphone 112 to a numerical representation.

The difference signal may essentially correspond to a difference between the second sound signal (in-ear sound signal collected by microphone 112) and the first sound signal (target sound signal). In other words, sound correction determining unit 114 may be adapted to calculate a difference between the in-ear sound signal and the target sound signal, e.g. by a difference determining unit (not shown).

The difference signal may, for example, be equal to the difference between the second sound signal and the first sound signal. However, the difference signal may also slightly deviate form the difference between the second sound signal and the first sound signal. As mentioned above, deviations may occur e.g. due to rounding errors which may take place during a calculation within the data processor included in sound correction determining unit 114, for example when calculating the difference between the second sound signal and the first sound signal. Further, deviations may also be introduced due to measurement errors, e.g. when mapping sound collected by microphone 112 to a numerical representation.

For example, the difference may be determined by subtracting the in-ear sound signal from the target sound signal at a plurality of points in time. This allows determining the difference signal as corresponding to a difference over time.

The difference signal may be phase-inverted, e.g. by shifting the phase of the difference signal by a phase shift of 180°. The phase inversion of the difference signal may also be obtained in a corresponding, but easier to calculate manner, e.g. by multiplying the difference signal over time by a negative factor, e.g. by −1. The resulting phase-inverted signal may therefore essentially correspond to the difference signal, but with a shifted phase by 180°.

Further, by weighting the phase-inverted signal, e.g. by a reflection factor, a weighted and phase-inverted signal may be obtained. The reflection factor may be determined as a reflection factor of the device when inserted in the ear canal in a regular position of use. The reflection factor may for example correspond to a ratio between amplitudes of sound waves inclining to and reflected from earphone 100.

The correction component may be determined based on the weighted and phase-inverted signal. The weighted and phase-inverted signal may for example be included into the correction component, and/or the correction component may essentially correspond to the weighted and phase-inverted signal.

The correction component may be included in the third sound signal (emission sound signal). The emission sound signal may thus include the target sound signal and the correction component.

As a result of phase-inversion and weightening of the difference signal, the correction component included in the emission sound signal may be adapted to essentially cancel, i.e. annihilate, eliminate, neutralize, and/or nearly entirely attenuate the difference signal. Consequently, the target sound signal may be percepted, i.e. heard and appreciated, without any disturbing signal components, e.g. originating from body sounds reflected at in-ear earphone 100 or from reflections of sound signals emitted by loudspeaker 116 from walls 108-1, 108-2 of ear canal 102. Thus, the quality of sound and a comfortable wearing of in-ear earphone 100 is enhanced.

In an embodiment, the correction component may essentially correspond to an anti-sound signal adapted to essentially cancel the difference signal. In this case, the correction component may have the same or about the same amplitude as the difference signal but with inverted phase, e.g. shifted by 180°. The sound waves of the correction component may thus interfere with the difference signal, and correspondingly cancel the difference signal from the in-ear sound signal. The difference signal may thus be nearly or entirely attenuated from the in-ear sound signal. As a consequence, the sound waves arriving at middle ear ME of the user essentially correspond to the target sound signal. The difference signal may be effectively cancelled from the in-ear signal since ear canal 102 forms a small tubular structure, sealed up by in-ear earphone 100, in which noise cancellation may effectively be achieved.

In an embodiment, the third sound signal (emission sound signal) essentially corresponds to a sum of the first sound signal (target sound signal) and the correction component. E.g. the third sound signal may be equal to the sum, or may slightly deviate from the sum due to measurement, rounding and/or numerical representation errors. In this embodiment, the emission sound signal may be determined by sound correction determining unit 114 by adding the correction component to the target sound signal at a plurality of points in time.

As described in the above, sound determining unit 110 may correspond to a first microphone adapted to collect sound from an environment exterior to the ear canal. In this embodiment, in-ear earphone 100 may support the user as a hearing aid. With a hearing aid according to the embodiment, the user may appreciate transmission and/or amplification of environmental sound transmitted through ear canal 102, while canceling any unwanted reflections from ear phone 100 within ear canal 102. This enhances a wearing comfort and a quality of the sound perceptible by the user.

Figure 2:
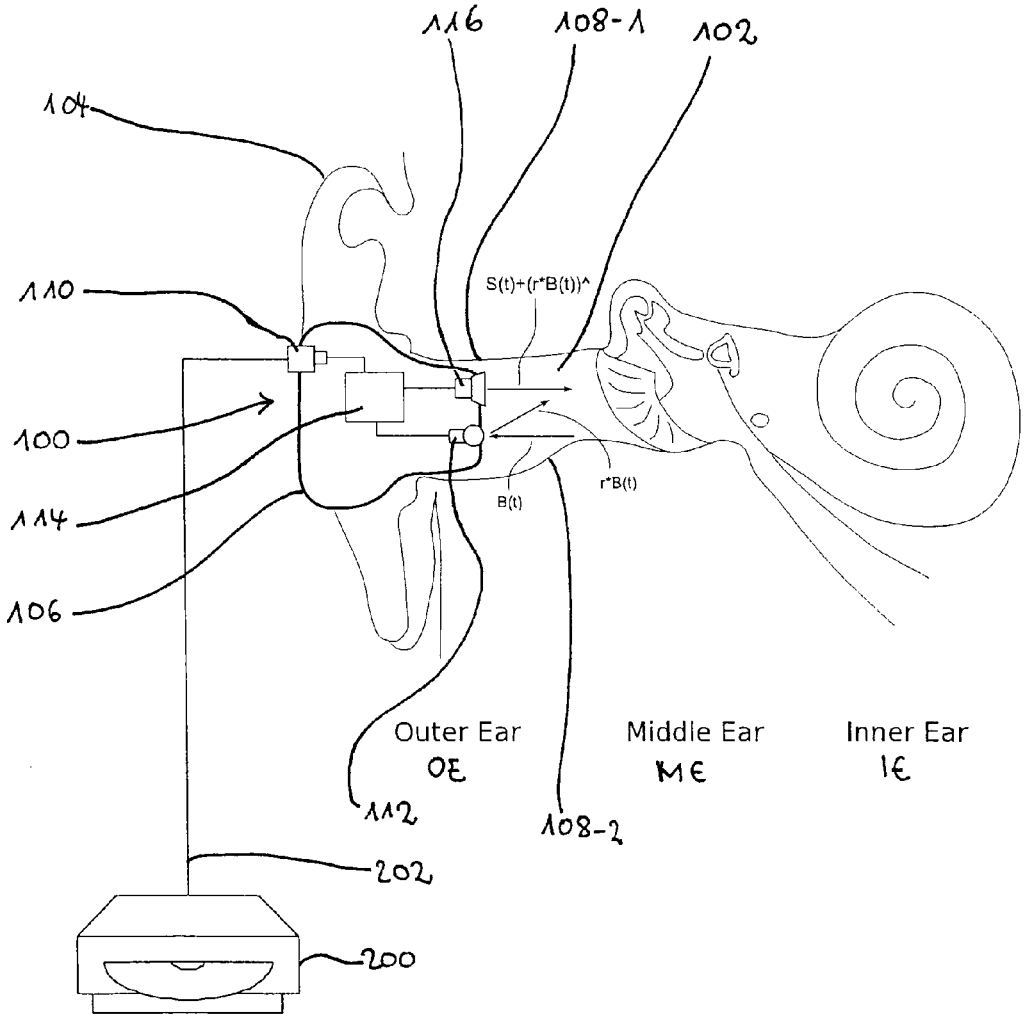
FIG. 2 illustrates a further embodiment of a device for in-ear sound generation.

FIG. 2 shows a further embodiment in which sound determining unit 110 is adapted to receive the target sound signal (first sound signal) from a further device. The further device may, for example, be a media player 200 connected to sound determining unit 110 of in-ear earphone 100, e.g. via a connection line 202 and/or via a wireless connection. The further device connected to sound determining unit 110 may also be a cell phone, a telephone, a television apparatus, a computer or the like. The further device may also be a hybrid device, including functionality of different kinds of devices as mentioned above. Thus, in-ear earphone 100 may be used together with a wide variety of further devices external.

Figure 3A:
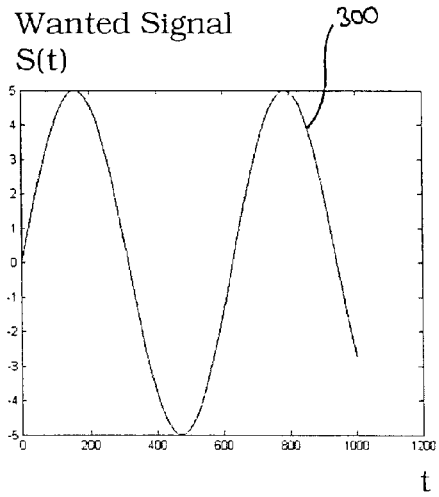
FIG. 3*a* illustrates a wanted sound signal which is to be made perceptible to the user.

In FIG. 3*a*, a wanted signal S(t) is depicted as a sound wave 300 over time t. Wanted signal S(t) may be regarded as the target sound signal (first sound signal) determined by sound determining unit 110 of FIG. 1 or 2.

Figure 3B:
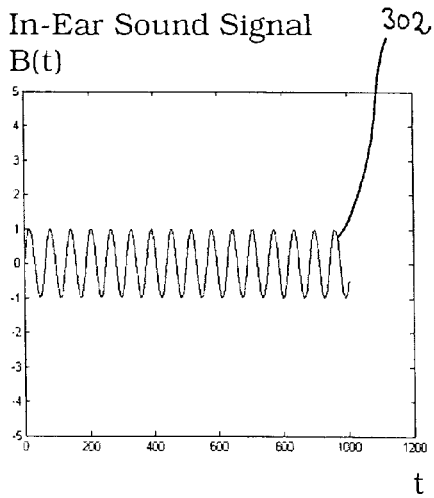
FIG. 3*b* illustrates an in-ear sound signal present in the ear canal of the user.

FIG. 3*b* shows an in-ear sound signal B(t), which is depicted as a further sound wave 302 over time t. In-ear sound signal B(t) may for example be regarded as a body sound signal emanating from the body of the user, and may be introduced into ear canal 112 e.g. by vibration of walls 108-1, 108-2. Further, also reflections of sound signals, reflected at in-ear earphone 100 inserted in ear canal 102 as shown in FIG. 1 or 2, may form part/be included in in-ear sound signal B(t).

Figure 3C:
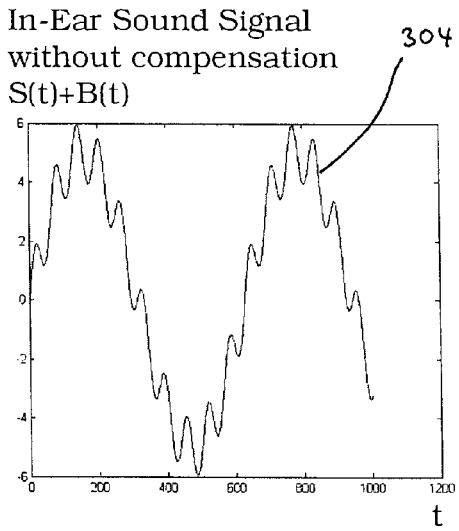
FIG. 3*c* illustrates an in-ear sound signal without compensation which would be perceptible for the user in case the wanted sound signal illustrated in FIG. 3*a* is emitted without compensation while the in-ear sound signal illustrated in FIG. 3*b* is present in the ear canal.

In FIG. 3*c*, an in-ear sound signal without compensation S(t)+B(t) is depicted over time t as a sound wave 304. The in-ear sound signal without compensation S(t)+B(t) would essentially be experienced by the user if wanted signal S(t) would be emitted by loudspeaker 116 without any correction. In this case, wanted signal S(t) and in-ear sound signal B(t) would interfere within ear canal 102, thereby resulting in a sound wave essentially corresponding to the one depicted in FIG. 3*c*.

Figure 4A:
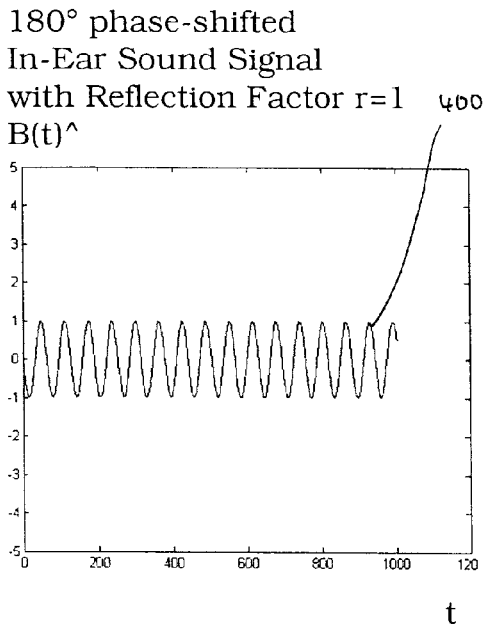
FIG. 4*a* illustrates a 180° phase-shifted in-ear sound signal derived from the in-ear sound signal illustrated in FIG. 3*b*.

FIG. 4*a* shows a 180° phase-shifted in-ear sound signal with reflection factor r=1 as a sound wave 400 over time t. This signal may be obtained by a phase-shifting of in-ear body sound signal B(t) depicted in FIG. 3*b*. When denoting phase-shifting by 180° by ˆ, and denoting multiplication by *, the signal depicted in FIG. 4*a* may be denoted as r*B(t)ˆ. Reflection factor r=1 may be appropriate if the correction component shall be adapted to merely entirely attenuate in-ear body sound signal B(t).

Figure 4B:
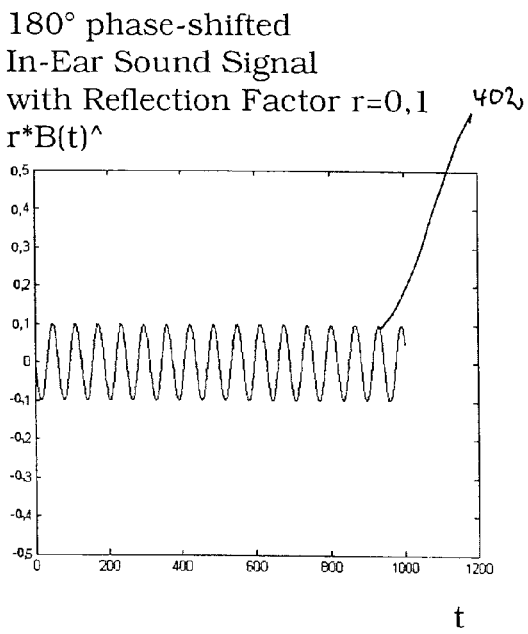
FIG. 4*b* illustrates a 180° phase-shifted in-ear sound signal derived from the in-ear sound signal illustrated in FIG. 3*b* with a reflection factor r=0,1.

In FIG. 4*b*, a 180° phase-shifted in-ear sound signal with reflection factor r=0,1 is depicted as a sound wave 402 over time t. Reflection factor r=0,1 may be appropriate if it is known that due to a configuration of in-ear earphone 100, a major part of in-ear body sound signal B(t) is absorbed, while only a minor part is reflected. In this case, the correction component only needs to attenuate the reflected minor part of in-ear sound signal B(t).

Figure 4C:
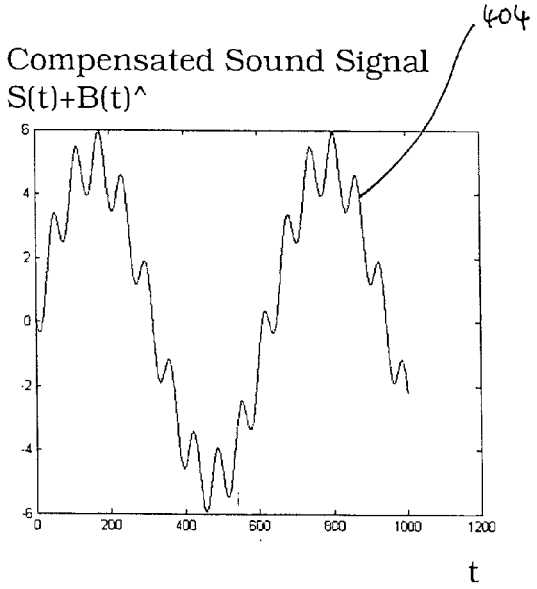
FIG. 4*c* illustrates a compensated sound signal determined based on the wanted sound signal illustrated in FIG. 3*a* and the 180° phase-shifted in-ear sound signal illustrated in FIG. 4*a*.

In FIG. 4*c*, a compensated sound signal is depicted as a sound wave 404 over time t. In the example, the compensated sound signal essentially corresponds to S(t)+B(t)ˆ obtained by adding wanted signal S(t) and 180° phase-shifted in-ear sound signal B(t)ˆ with reflection factor r=1.

Figure 5:
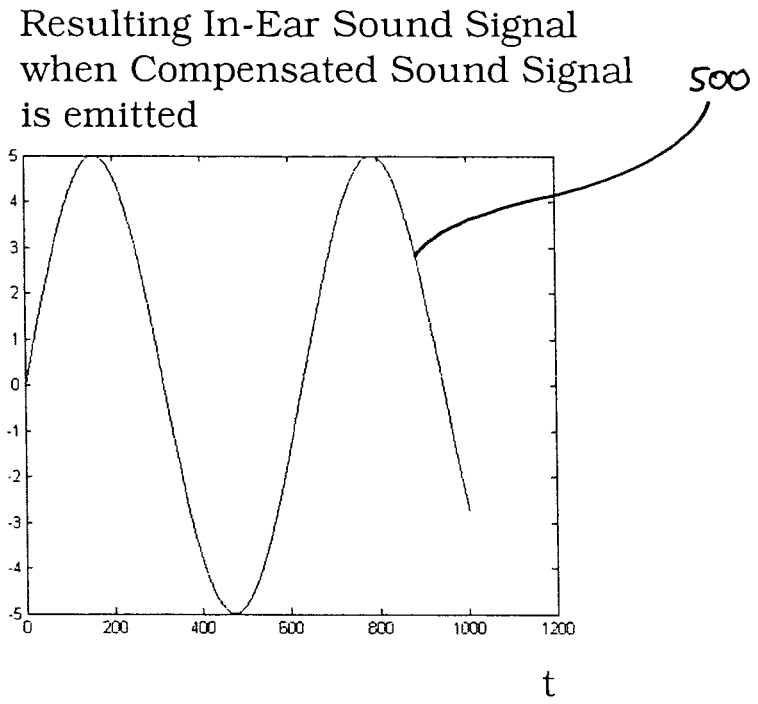
FIG. 5 illustrates a resulting in-ear sound signal when the compensated sound signal illustrated in FIG. 4*c* is emitted.

When emitting compensated sound signal as the emission sound signal (third sound signal) via loudspeaker 116 to in-ear canal 102, the emitted sound signal interferes with in-ear sound signal B(t). Thus, the sound wave corresponding to in-ear sound signal B(t) may be essentially cancelled within the tubular structure of ear canal 102. Correspondingly, an in-ear signal as depicted in FIG. 5 by a sound wave 500 over time t is established within ear canal 102. The in-ear signal essentially corresponds to wanted signal S(t) as depicted in FIG. 3*a*, since in-ear sound signal B(t) as depicted in FIG. 3*b* is essentially cancelled, e.g. from in-ear sound signal without compensation S(t)+B(t) as depicted in FIG. 3*c*. Thus, a high quality of sound without any disturbing sound signals and interferences caused by reflections of in-ear earphone 100 may be appreciated by the user.

Figure 6:
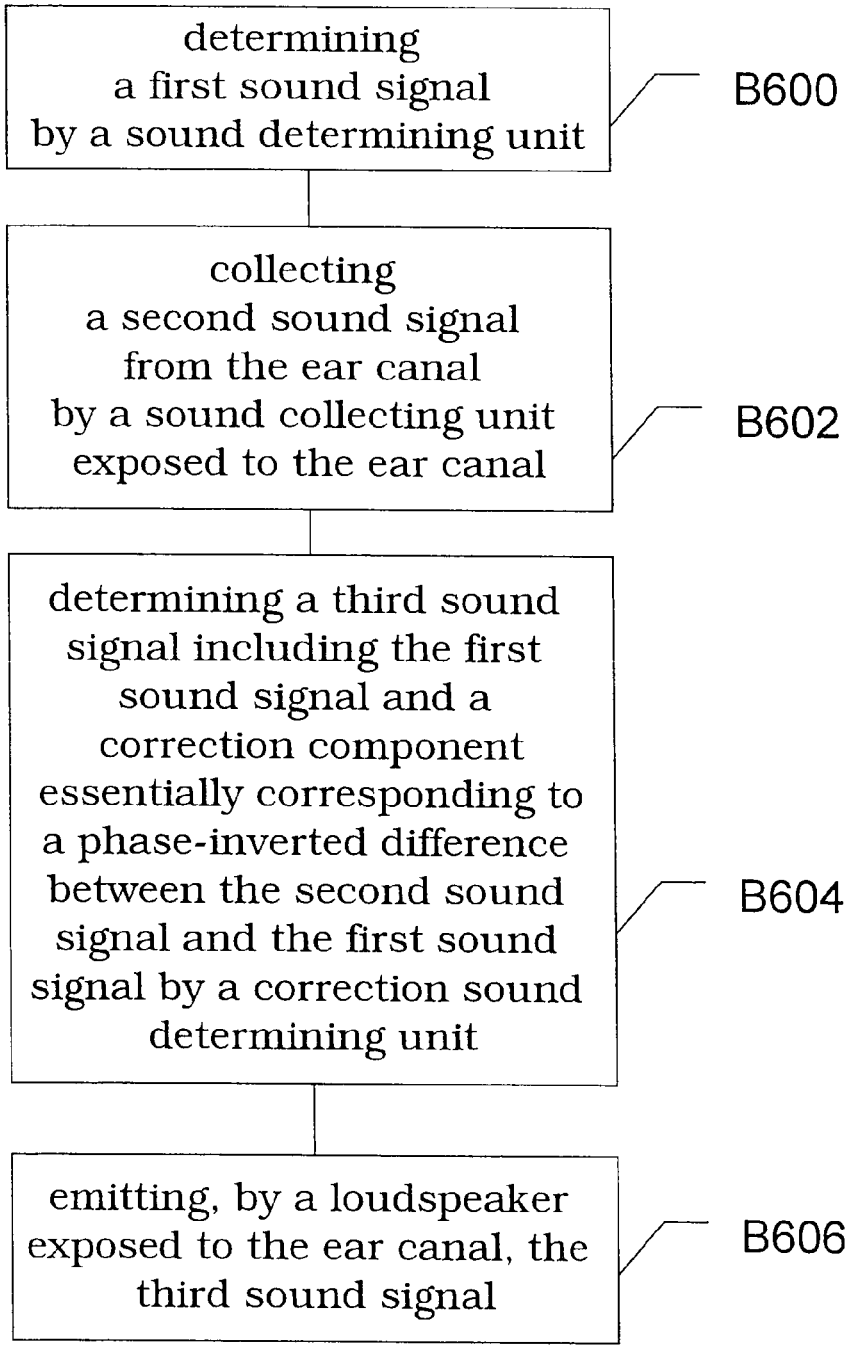
FIG. 6 illustrates an embodiment of a method for in-ear sound generation.

In FIG. 6, a method for generating sound by a device for in-ear sound generation, e.g. corresponding to the one depicted in FIG. 1 or 2, is illustrated. At B600, a first sound signal (target sound signal) is determined by a sound determining unit, e.g. sound determining unit 110 as depicted in FIGS. 1 and 2.

At B602, a second sound signal (in-ear sound signal) is collected from ear canal 102, e.g. by a sound collecting unit such as microphone 112, exposed to ear canal 102.

At B604, a third sound signal (emission sound signal) is determined. This third sound signal may include the first sound signal (target sound signal) and a correction component. The correction component may essentially correspond to a weighted and phase-inverted signal. The phase-inverted signal may be obtained by phase-inversion from a difference signal essentially corresponding to a difference between the second sound signal and the first sound signal, as described in detail in the above. As mentioned above, the correction component may be equal to the weighted and phase-inverted signal, or may slightly deviate from the latter e.g. due to measurement, rounding and/or numerical representation errors. Further, the difference signal may be equal to a difference between the second sound signal and the first sound signal, or may slightly deviate from the latter e.g. due to measurement, rounding and/or numerical representation errors.

At B606, the third sound signal (emission sound signal) is emitted by a loudspeaker, such as loudspeaker 116 exposed to ear canal 102.

Figure 7:
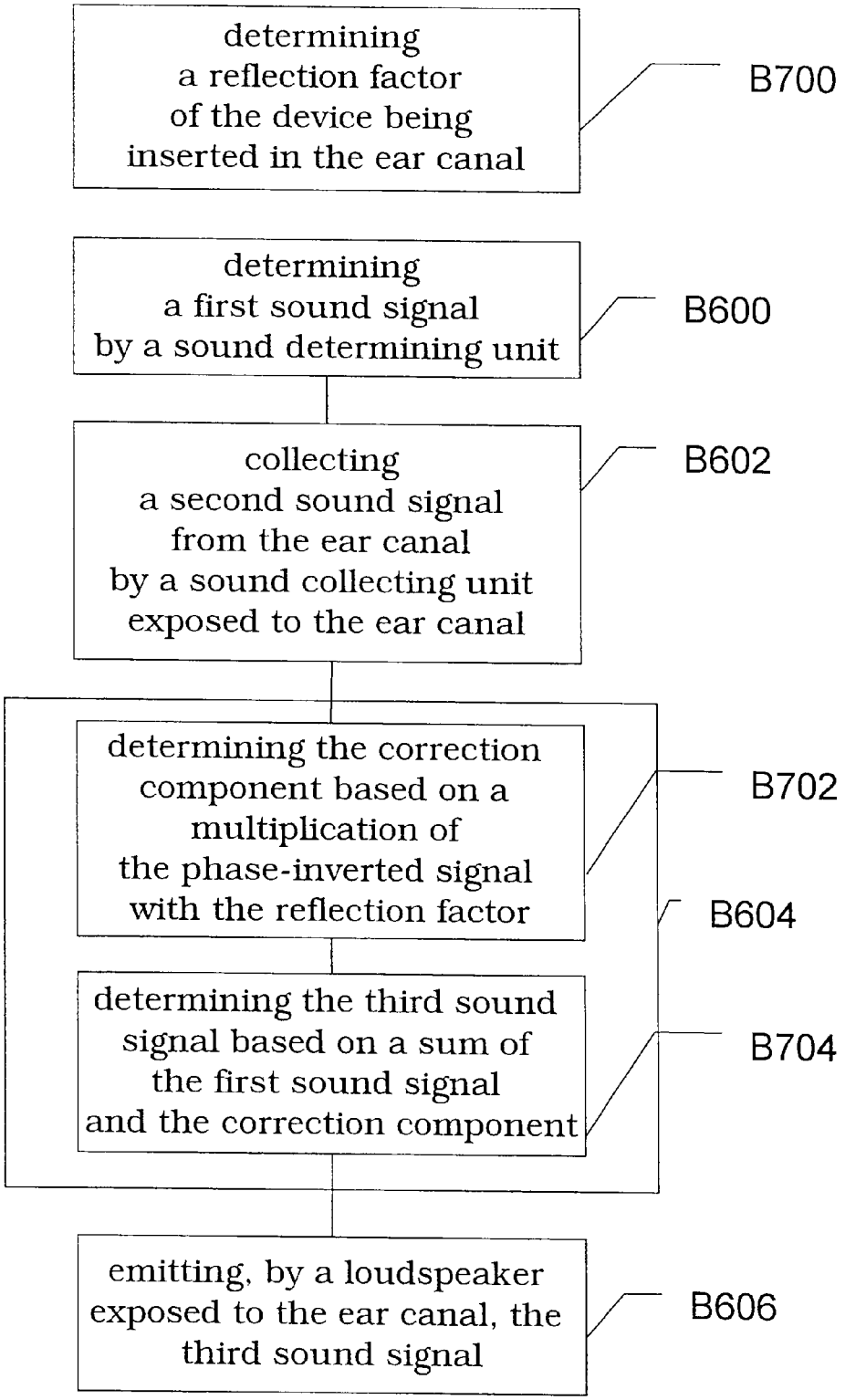
FIG. 7 illustrates a further embodiment of a method for in-ear sound generation.

The embodiment of the method of generating sound depicted in FIG. 7 essentially corresponds to the one depicted in FIG. 6. Blocks B600, B602 and B606 therefore may essentially correspond to the ones with like numerals of FIG. 6. However, in FIG. 7, the reflection factor mentioned above is determined at B700. The reflection factor may be device-specific and/or depending on a structural configuration of in-ear earphone 100, and may therefore be determined once within a lifetime of in-ear earphone 100. The reflection factor may, for example, be determined once when in-ear earphone 100 is manufactured, and may be encoded persistently e.g. within sound correction determining unit 114. Accordingly, block B700 of FIG. 7 is not connected with B600.

In block B604, at B702, the correction component is determined based on a multiplication of the phase-inverted signal with the reflection factor. In other words, the correction component may be determined by multiplying the phase inverted signal with the reflection factor.

At B704, the third sound signal (emission sound signal) is determined based on a sum of the first sound signal (target sound signal) and the correction component. In other words, third sound signal may be determined by adding the first sound signal and the correction component. Consequently, the third sound signal may correspond to or at least essentially correspond to the sum of the first sound signal and the correction component.

Consequently, the emission sound signal determined within the embodiments depicted in FIG. 1 or 2 and in accordance with the methods depicted in FIG. 6 or 7 may be adapted to essentially cancel an (unwanted) in-ear signal, potentially resulting from reflected body sounds or other unwanted reflections caused by in-ear earphone 100 inserted in ear canal 102, and to establish a sound signal corresponding to a target sound signal (wanted sound signal) within ear canal 102. Thus, a high quality of the sound appreciated by the user and a high wearing comfort may be achieved.

Although specific embodiments have been illustrated and described herein, it will be appreciated by those of skilled in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A device for in-ear sound generation, comprising:

a sound determining unit adapted to determine a first sound signal;

a sound collecting unit exposed to the ear canal and adapted to collect a second sound signal;

a sound correction determining unit adapted to determine a third sound signal; and a loudspeaker exposed to an ear canal and adapted to emit the third sound signal, wherein the third sound signal includes the first sound signal and a correction component, the correction component essentially corresponding to a weighted and phase-inverted signal, the phase-inverted signal being obtained by phase inversion from a difference signal, the difference signal essentially corresponding to a difference between the second sound signal and the first sound signal.

2. The device according to claim 1, wherein the correction component is proportional to the phase-inverted signal.

3. The device according to claim 1, wherein a ratio between the correction component and the phase-inverted signal essentially corresponds to a reflection factor of the device when inserted in the ear canal.

4. The device according to claim 1, wherein the correction component essentially corresponds to an anti sound signal adapted to essentially cancel the difference signal.

5. The device according to claim 1, wherein the third sound signal corresponds to a sum of the first sound signal and the correction component.

6. The device according to claim 1, wherein the sound collecting unit is open to the ear canal and disposed within a predetermined distance from walls of the ear canal.

7. The device according to claim 1, further comprising:

a housing adapted to be inserted into the ear canal and essentially closing the ear canal, wherein the loudspeaker and the sound collecting unit are disposed at the housing.

8. The device according to claim 1, wherein the sound determining unit is adapted to receive the first sound signal from a further device.

9. The device according to claim 1, wherein the device is an in-ear earphone.

10. The device according to claim 1, wherein the sound determining unit includes a microphone adapted to collect sound from an environment exterior to the ear canal.

11. The device according to claim 1, wherein the device is a hearing aid.

12. A method for generating sound in an in-ear device, comprising:

determining a first sound signal by a sound determining unit;

collecting a second sound signal from the ear canal by a sound collecting unit exposed to the ear canal;

determining a third sound signal by a correction sound determining unit; and emitting the third sound signal by a loudspeaker exposed to the ear canal, wherein the third sound signal includes the first sound signal and a correction component, the correction component essentially corresponding to a weighted and phase-inverted signal, the phase-inverted signal being obtained by phase inversion from a difference signal, the difference signal essentially corresponding to a difference between the second sound signal and the first sound signal.

13. The method according to claim 12, further comprising:

determining a reflection factor of the device being inserted in the ear canal; and determining the correction component based on a multiplication of the phase-inverted signal with the reflection factor.

14. The method according to claim 12, further comprising:

determining the third sound signal based on a sum of the first sound signal and the correction component.

* * * * *